US007166041B2

(12) United States Patent
Evans

(10) Patent No.: US 7,166,041 B2
(45) Date of Patent: Jan. 23, 2007

(54) GOLF CLUBHEAD WITH ADJUSTABLE WEIGHTING

(75) Inventor: D. Clayton Evans, San Marcos, CA (US)

(73) Assignee: Callaway Golf Company, Carlsbad, CA (US)

( * ) Notice: Subject to any disclaimer, the term of this patent is extended or adjusted under 35 U.S.C. 154(b) by 151 days.

(21) Appl. No.: 10/905,994

(22) Filed: Jan. 28, 2005

(65) Prior Publication Data

US 2006/0172821 A1 Aug. 3, 2006

(51) Int. Cl.
*A63B 53/04* (2006.01)
*A63B 53/06* (2006.01)

(52) U.S. Cl. ..... 473/334; 473/335; 473/349

(58) Field of Classification Search ..... 473/334–339, 473/244–247, 349, 345, 344
See application file for complete search history.

(56) References Cited

U.S. PATENT DOCUMENTS 2,155,830 A * 4/1939 Howard ..... 473/246
3,995,857 A 12/1976 Cochran et al.
5,282,625 A 2/1994 Schmidt et al.
5,447,309 A 9/1995 Vincent
5,769,737 A * 6/1998 Holladay et al. ..... 473/336
5,776,010 A 7/1998 Helmstetter et al.
5,785,605 A 7/1998 Helmstetter
5,971,867 A * 10/1999 Galy ..... 473/345
6,210,290 B1 4/2001 Erickson et al.
6,217,461 B1 4/2001 Galy
6,364,788 B1 4/2002 Helmstetter et al.
6,409,612 B1 6/2002 Evans et al.
6,440,009 B1 8/2002 Guibaud et al.
6,471,604 B2 * 10/2002 Hocknell et al. ..... 473/334
6,648,772 B2 11/2003 Vincent et al.
6,739,983 B2 5/2004 Helmstetter et al.
6,773,360 B2 8/2004 Willett et al.
2003/0232659 A1 * 12/2003 Mahaffey et al. ..... 473/256
2004/0176177 A1 * 9/2004 Mahaffey et al. ..... 473/256
2006/0122004 A1 * 6/2006 Chen et al. ..... 473/335

* cited by examiner

*Primary Examiner*—Sebastiano Passaniti
(74) *Attorney, Agent, or Firm*—Michael A. Catania; Elaine H. Lo

(57) ABSTRACT

A golf club head (20) with an adjustable weight member (50) is disclosed herein. The weight member (50) is preferably positioned within a recess (40) of the golf club head (20). The weight member (50) is moved to a desired location and locked in place using a locking mechanism. The weight member (50) is preferably composed of a material having a greater density than the density of the material of a body (22) of the golf club head (20).

13 Claims, 9 Drawing Sheets

GOLF CLUBHEAD WITH ADJUSTABLE WEIGHTING

BACKGROUND OF THE INVENTION

1. Field of the Invention

The present invention relates to a golf club head with adjustable weighting. More specifically, the present invention relates to a golf club head that allows a golfer to modify the placement of mass.

2. Description of the Related Art

Numerous techniques have been used for weighting golf club heads in order to gain better performance. In persimmon wood club heads, weights were attached to the sole in order to lower the center of gravity. The first metal woods had sufficient weight, however, the weight distribution deterred slightly from performance. The refinement of hollow metal woods with weighting on the sole improved upon the performance of these clubs. An example of such woods were the GREAT BIG BERTHA® HAWK EYE® drivers and fairway woods, developed by the Callaway Golf Company of Carlsbad, Calif., that used a tungsten screw in the sole of each titanium club head body to vary the weight of the golf club head.

Another example is set forth in Helmstetter et al., U.S. Pat. No. 6,364,788 for a Weighting System For A Golf Club Head, which discloses using a bismuth material within an internal cavity to add mass to a golf club head, particularly a fairway wood.

Yet a further example is set forth in Evans et al., U.S. Pat. No. 6,409,612 for a Weighting Member For A Golf Club Head, which discloses a weighting device composed of a polymer body with ports to allow for placement of high density members such as tungsten spheres.

Another example of additional weighting of a golf club head is set forth in U.S. Pat. No. 5,447,309, which discloses the use of three weights fixedly disposed within the interior of a club head to provide a selected moment of inertia for the club head. Yet another example is set forth in British Patent Application Number 2332149 for a Golf Club Head With Back Weighting Member, which discloses a weight pocket in the exterior rear of a wood for placement of epoxy inserts that vary in density.

In irons, weighting of the club head has assumed many variations. One example is perimeter weighting in which the mass is shifted to the perimeter of the club head such as the BIG BERTHA® X-12® irons developed by the Callaway Golf Company and as set forth in U.S. Pat. No. 5,282,625. An example of additional weighting is set forth in U.S. Pat. No. 3,995,857 which discloses the placement of tungsten inserts into the rear of an iron.

Another example of additional weighting is the GREAT BIG BERTHA® TUNGSTEN-TITANIUM™ irons, developed by the Callaway Golf Company, which used a screw to attach a tungsten block to the rear and sole of a stainless steel iron as set forth in U.S. Pat. No. 5,776,010.

Yet another example is the GREAT BIG BERTHA® TUNGSTEN-INJECTED™ HAWK EYE® irons, also developed by the Callaway Golf Company, which feature an internal cavity with tungsten pellets in a solder, as set forth in U.S. Pat. No. 6,210,290, for a Golf Club And Weighting System. The weighting of putters has varied as with woods and irons.

An example of positioning mass in a golf club head for performance is disclosed in Helmstetter et al., U.S. Pat. No. 6,739,983 for a Golf Club Head With Customizable Center Of Gravity, which discloses a method and golf club head which allows a golfer to select a preferred center of gravity location for better ball striking.

A further example of positioning mass for performance is set forth in Helmstetter, U.S. Pat. No. 5,785,605 for a Hollow, Metallic Golf Club Head With Configured Medial Ridge, which discloses a golf club head with a center of gravity located in vertical alignment with a local zone defined by ridge on a sole of the golf club head.

However, prior technology have been similar in that the weighting means, whether it is a medallion, plug, insert or the like, is a static weight and mass. More precisely, once positioned on the club head, the weight does not change. If a new weight is desired, then the old weight is removed and an entirely new weight means is placed on the golf club head. The weights may be ground to remove mass in order to lower the weight, however, these prior art weights cannot easily have their mass increased by the addition of material.

Further, each of the prior art weighting means have a fixed and unchangeable center of gravity ("CG") and fixed and unchangeable moments of inertia ("MOI"). The CG cannot be moved and the MOI cannot be increased or decreased without dimensionally changing the prior art weighting means. Thus, the golf industry needs a weighting mechanism that allows for greater flexibility to adjust, the CG, MOI and also the swingweight on a golf club.

BRIEF SUMMARY OF THE INVENTION

One aspect of the present invention is a golf club head having a body and at least one weight member. The body has a face, a crown and a sole. The body also has an arc-like recess extending from a heel end of the body to a toe end of the body. The body also has an arc-like track extending from the heel end of the body to the toe end of the body with a plurality of locking notches in communication with the arc-like track. The at least one weight member is positioned within the arc-like recess and movable within the arc-like recess to influence the center of gravity and other mass properties of the golf club head. The at least one weight member has at least one locking projection positioned within the arc-like track and movable within the arc-like track and capable of placement within each of the plurality of locking notches. The at least one weight member also has a locking mechanism for locking the at least one weight member in a position within the arc-like recess.

Another aspect of the present invention is a fairway-wood type golf club head having a body and a weight member. The body has a face, a crown and a sole with a ribbon portion and a bottom portion. The body has an arc-like recess extending from a heel end of the body to a toe end of along the ribbon portion of the sole. The body has an upper arc-like track extending from the heel end of the body to the toe end of the body with a plurality of locking notches in communication with the upper arc-like track and a lower arc-like track extending from the heel end of the body to the toe end of the body with a plurality of locking notches in communication with the lower arc-like track. The weight member is positioned within the arc-like recess and movable within the arc-like recess. The weight member has a body with a plurality of locking projections with at least one of the plurality of locking projections positioned within the upper arc-like track and movable within the upper arc-like track and capable of placement within each of the plurality of locking notches, and with at least one of the plurality of locking projections positioned within the lower arc-like track and movable within the lower arc-like track and capable of placement within each of the plurality of locking notches. The weight member also has a locking mechanism for locking the weight member in a position within the arc-like recess.

Yet another aspect of the present invention is a method for providing a golfer with a golf club having a center of gravity oriented for the golfer. The method includes a determining a desired center of gravity location of a golf club for a golfer from the group of far heel ward, mid-heel ward, slight heel ward, neutral, slight toe ward, mid-toe ward and far toe ward. Next, a weight member is positioned in a location to achieve the desired center of gravity location. The weight member is positioned within an arc-like recess of a golf club head and movable within the arc-like recess to achieve the desired center of gravity location.

The method may also include positioning the weight member by unlocking the locking cam nut to decompress the bushing to allow the weight member to move along the recess to a location that provides the desired center of gravity location for the golfer and locking the locking cam nut to compress the bushing against the body of the golf club head.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
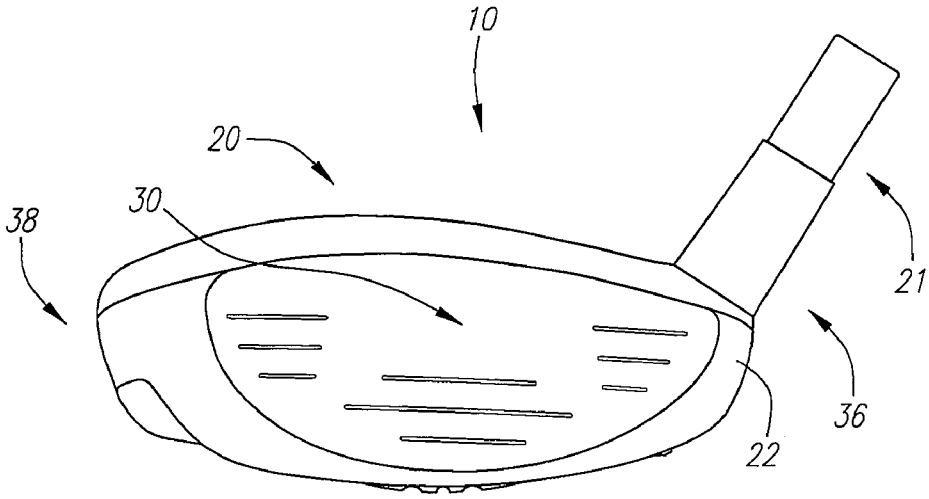
FIG. 1 is a front view of a golf club of the present invention.
Figure 2:
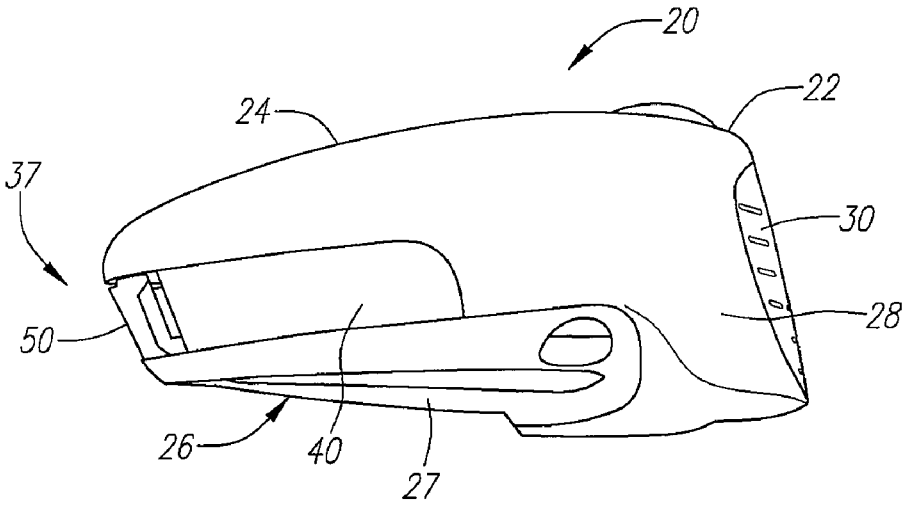
FIG. 2 is a toe side view of a golf club head of the present invention.
Figure 3:
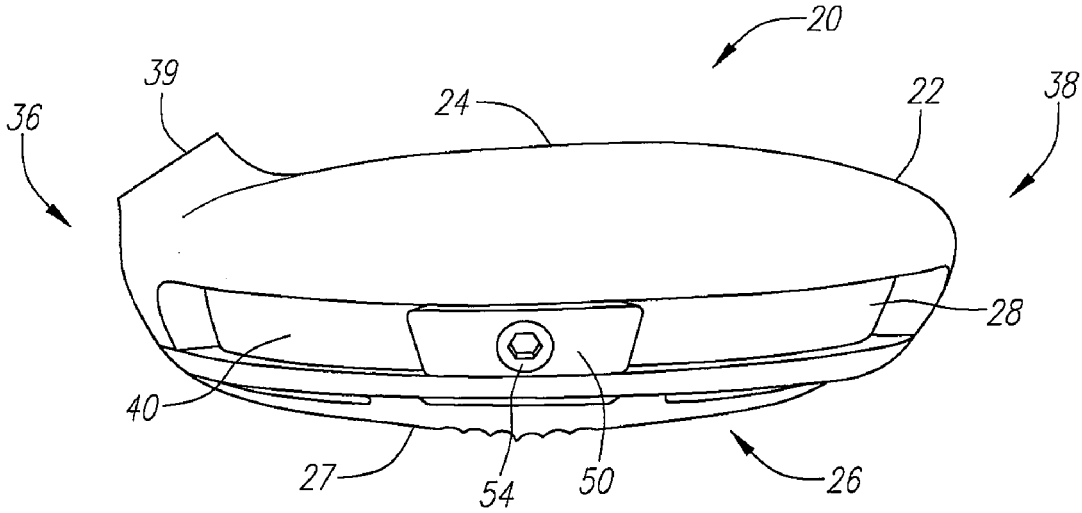
FIG. 3 is a rear view of a golf club head of the present invention.
Figure 4:
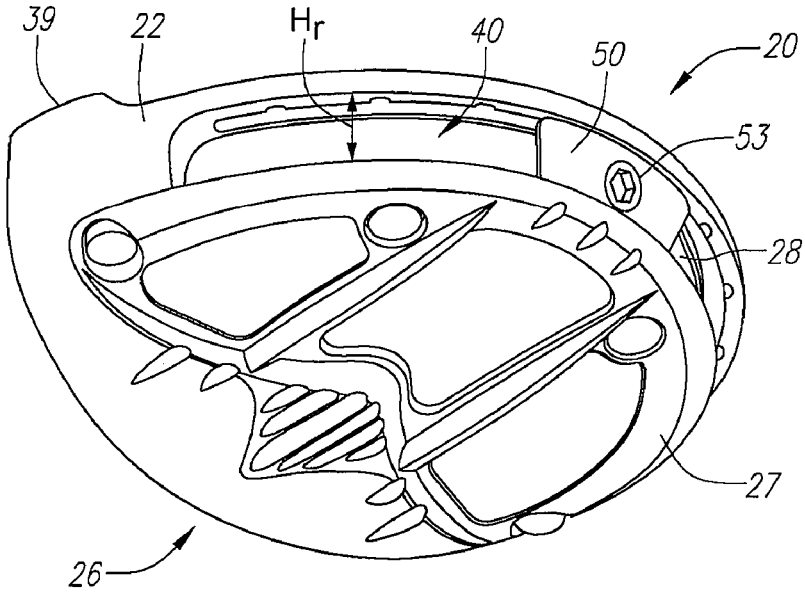
FIG. 4 is a bottom perspective view of a golf club head of the present invention.
Figure 5:
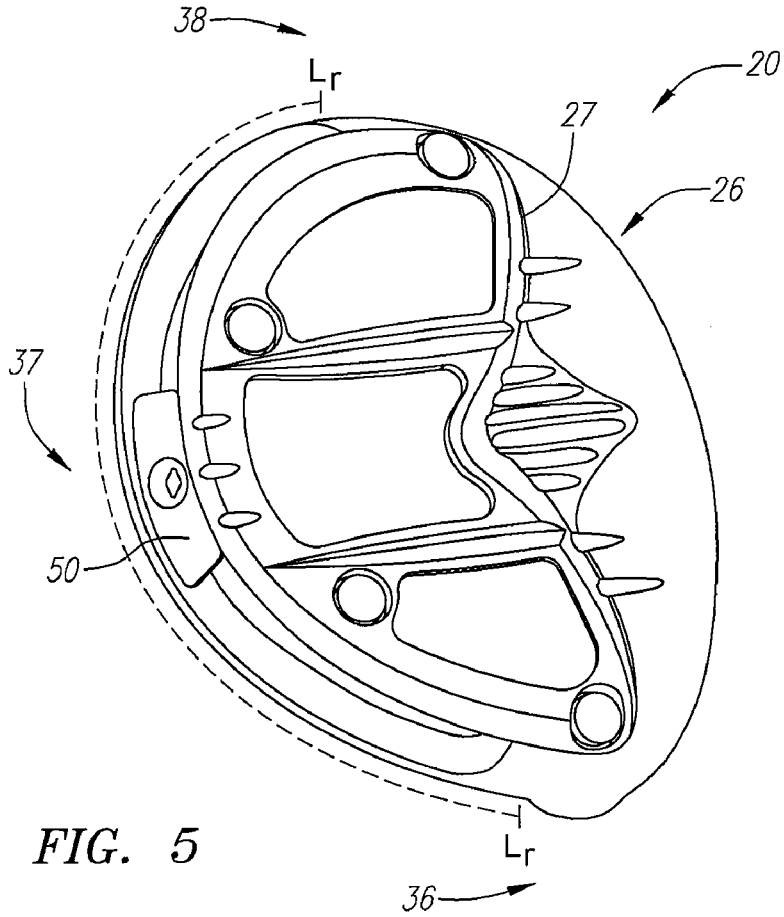
FIG. 5 is a bottom plan view of a golf club head of the present invention.

A golf club 10 is illustrated in FIG. 1. As shown in FIGS. 2–6, a golf club head is generally designated 20. The golf club head 20 of FIGS. 2–6 is a fairway wood, however, the golf club head 20 of the present invention may alternatively be a driver. The golf club head 20 has a body 22 that is preferably composed of a metal material such as titanium, titanium alloy, stainless steel, or the like, and is most preferably composed of a cast stainless steel material. The body 22 is preferably cast from molten metal in a method such as the well-known lost-wax casting method. The metal for casting is preferably is composed of 17-4 steel alloy. Alternatively the body 22 is composed of a titanium or a titanium alloy such as 6-4 titanium alloy, alpha-beta titanium alloy or beta titanium alloy for forging, and 6-4 titanium for casting. Additional methods for manufacturing the body 22 include forming the body 22 from a flat sheet of metal, super-plastic forming the body 22 from a flat sheet of metal, machining the body 22 from a solid block of metal, electrochemical milling the body from a forged pre-form, and like manufacturing methods.

The golf club head 20 preferably has a volume from 100 cubic centimeters to 600 cubic centimeters, more preferably from 130 cubic centimeters to 475 cubic centimeters. When designed as a fairway wood, the golf club head 20 preferably has a volume ranging from 130 cubic centimeters to 300 cubic centimeters, and more preferably from 150 cubic centimeters to 275 cubic centimeters. The volume of the golf club head 20 will also vary between fairway woods (preferably ranging from 3-woods to eleven woods). When designed as a driver, the golf club head 20 preferably has a volume ranging from 300 cubic centimeters to 500 cubic centimeters, and more preferably from 350 cubic centimeters to 475 cubic centimeters.

The golf club head 20 preferably has a mass ranging from 90 grams to 250 grams, more preferably from 150 grams to 225 grams, and most preferably from 180 grams to 221 grams. The mass of the golf club head 20 will also vary between fairway woods (preferably ranging from 3-woods to eleven woods) and a driver.

In a preferred embodiment, the body 22 has a crown 24, a sole 26 with a bottom portion 27 and a ribbon portion 28, and a striking plate 30. The body 22 preferably has a hollow interior. The golf club head 20 has a heel end 36, a toe end 38 an aft end 37. A shaft 21, partially shown in FIG. 1, is placed within a hosel 39 at the heel end 36. In a preferred embodiment, the hosel is internal 39 to the body 22, and the shaft extends to the sole 26. Alternatively, the hosel 39 is an exterior hosel and a butt end of the shaft 21 is placed therein.

Figure 6:
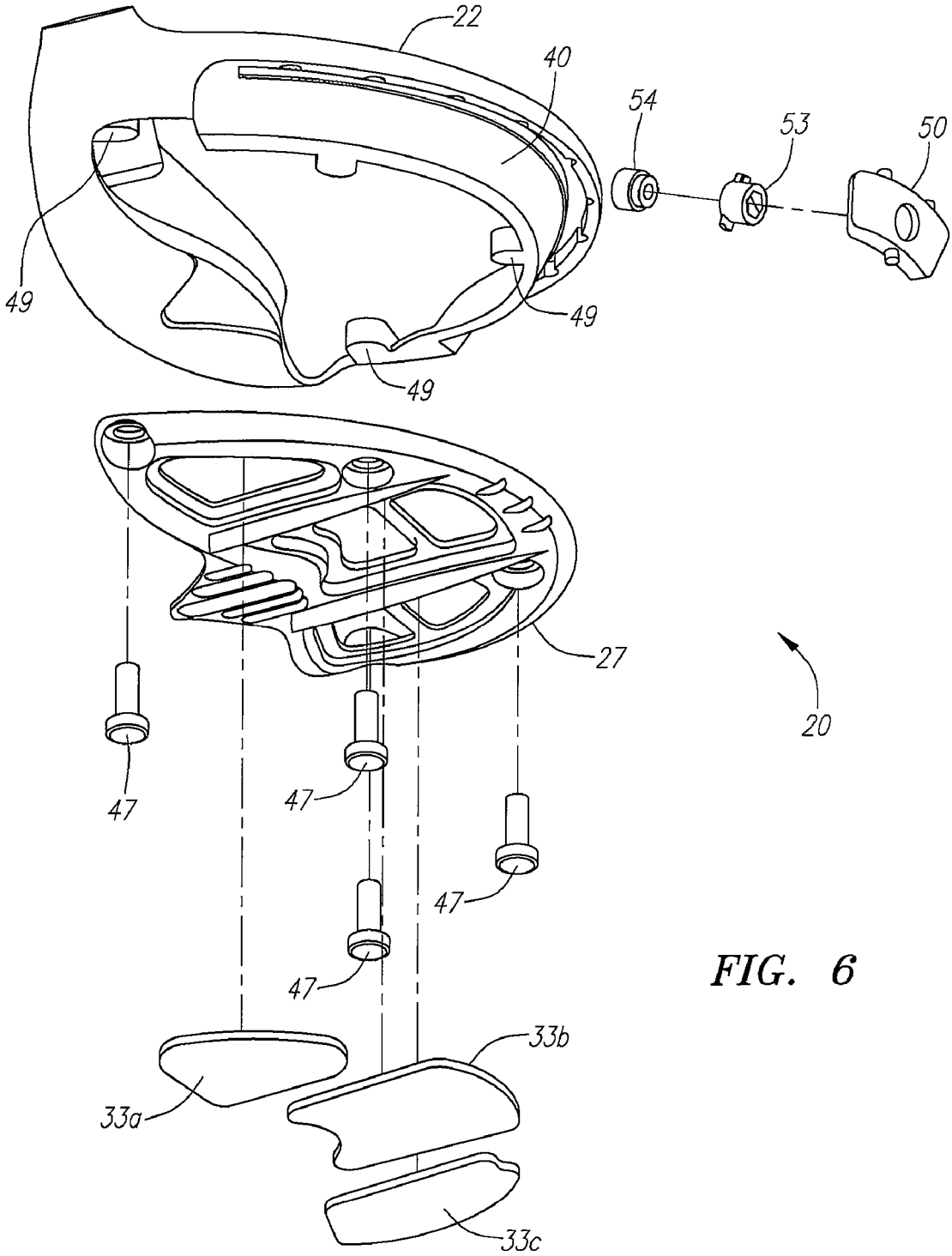
FIG. 6 is an exploded bottom view of a golf club head of the present invention.
Figure 7:
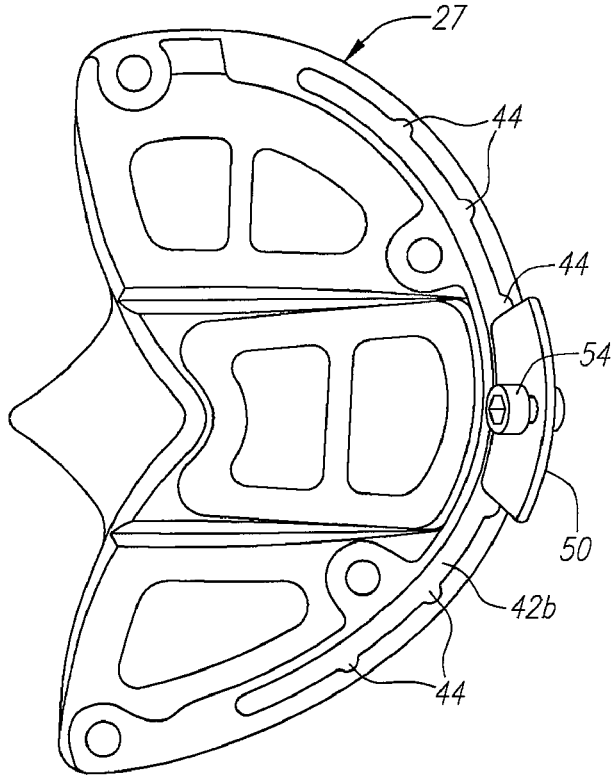
FIG. 7 is an isolated view of a sole plate of a golf club head of the present invention.

In a preferred embodiment, the bottom portion 27 of the sole 26 is a separate component which is attachable to the body 22 by known attachment means. In a preferred embodiment, the bottom potion 27 is attached to the body 22 utilizing a plurality of bolts 47, each of the plurality of bolts 47 threaded into a corresponding threaded aperture 49 of a plurality of threaded apertures 49 of the body 22, such as shown in FIG. 6. Such a preferred attachment means allows for the use of dissimilar materials between the body 22 and bottom portion 27. The bottom portion also preferably has a plurality of covers 33*a*–33*c* which are preferably composed of a polymer material and have indicia thereon. In an alternative embodiment, the bottom portion 27 is cast with the body 22 or welded to the body 22.

Figure 8:
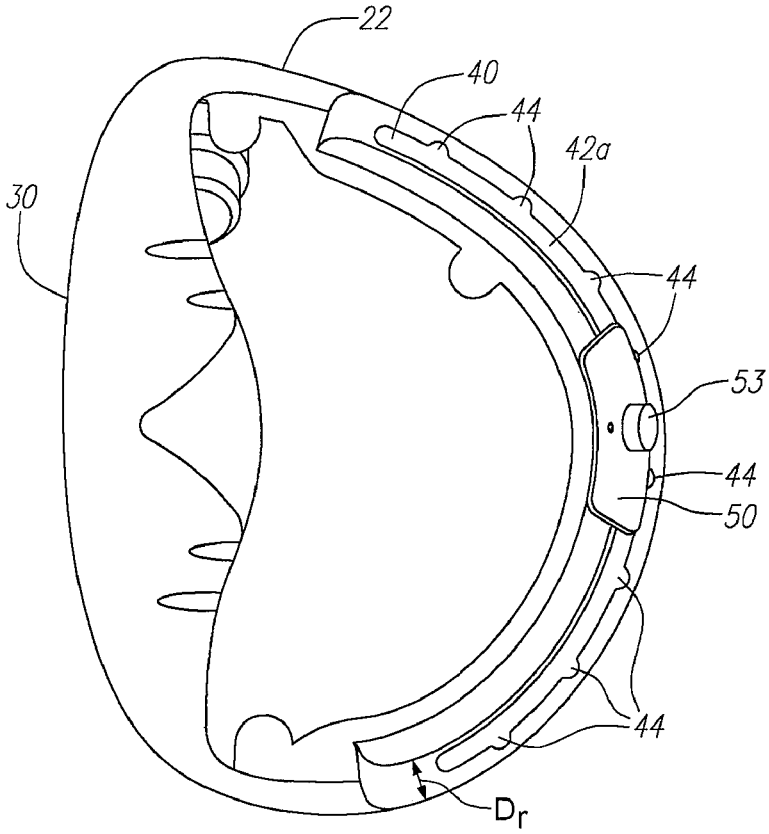
FIG. 8 is an isolated bottom view of a body of the golf club head without a sole plate to illustrate the arc-like track and locking notches.

The body has a recess 40, which preferably is an arc-like recess extending from a heel end 36 of the body 22 to a toe end 38 of the body 22. In alternative embodiments, the recess extends along only a portion of body 22. Preferably, the recess 40 is located along the ribbon portion 28 of the sole 26. The recess 40 preferably has a height, "Hr" (shown in FIG. 4), ranging from 0.5 centimeter to 4.0 centimeters, a depth, "Dr" (shown in FIG. 8), ranging from 0.2 centimeter to 2.0 centimeters, and an arc length "Lr" (dashed line shown in FIG. 5), ranging from 2 centimeters to 20 centimeters. More preferably, the recess 40 has a height, Hr, ranging from 1.0 centimeter to 2.0 centimeters, a depth, Dr, ranging from 0.5 centimeter to 1.0 centimeter, and an arc length Lr, ranging from 10 centimeters to 15 centimeters.

In a preferred embodiment, the body 22 has an arc-like track 42 in communication with the recess 40. In a most preferred embodiment, the body has an upper arc-like track 42*a* positioned above the recess 40, and a lower arc-like track 42*b* positioned below the recess 40. In a preferred embodiment, the lower track 42*b* is formed within the bottom portion 27. Each of the arc-like tracks 42*a* and 42*b* has a plurality of locking notches 44 therein. Each of the arc-like tracks 42*a* and 42*b* preferably has an arc length that is similar to the arc-length of the recess 40. The upper arc-like track 42*a* is formed into a ceiling wall that partially defines the recess 40. The width of the upper arc-like track 42*a* is preferably 0.025 centimeter to 1.0 centimeter and the height is preferably 0.025 centimeter to 1.0 centimeter. The lower arc-like track 42*b* is formed into a floor that partially defines the recess 40. The width of the lower arc-like track 42*b* is preferably 0.025 centimeter to 1.0 centimeter and the height is preferably 0.025 centimeter to 1.0 centimeter.

The weight member 50 is preferably composed of a high density material having a density greater than the density of a typical club head material, such as steel (density of 7.87 g/cc), or titanium (density of 4.51 g/cc). Preferably, the weight member 50 is composed of tungsten (density of 19.25 g/cc), copper (density of 8.93 g/cc), gold (density of 19.28 g/cc), silver (density of 10.50 g/cc), palladium (density of 12.00 g/cc), platinum (density of 21.47 g/cc) or another similar material. A preferred material for the weight member 30 is tungsten or tungsten alloy. An alternative material is a nickel-tungsten-chromium alloy such as disclosed in U.S. patent application Ser. No. 10/604,518, filed on Jul. 28, 2003 for a High Density Alloy For Improved Mass Properties In An Article, assigned to Callaway Golf Company of Carlsbad, Calif., and hereby incorporated by reference in its entirety. The weight member 50 preferably has a thickness ranging from 0.2 centimeter to 2.0 centimeters, a height ranging from 0.5 centimeter to 4.0 centimeters and a length ranging from 1.0 centimeter to 5.0 centimeters. More preferably, the weight member 50 has a thickness ranging from 0.5 centimeter to 1.0 centimeters, a height ranging from 1.0 centimeter to 2.0 centimeters and a length ranging from 2.5 centimeter to 4.0 centimeters. The weight member preferably has a mass ranging from 5 grams to 25 grams, more preferably from 7 grams to 20 grams and most preferably 10 grams.

Figure 11:
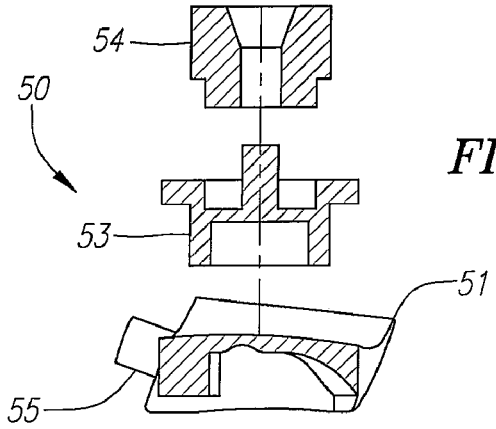
FIG. 11 is an exploded assembly cross-sectional view of the weighting member with its locking mechanism.
Figure 12:
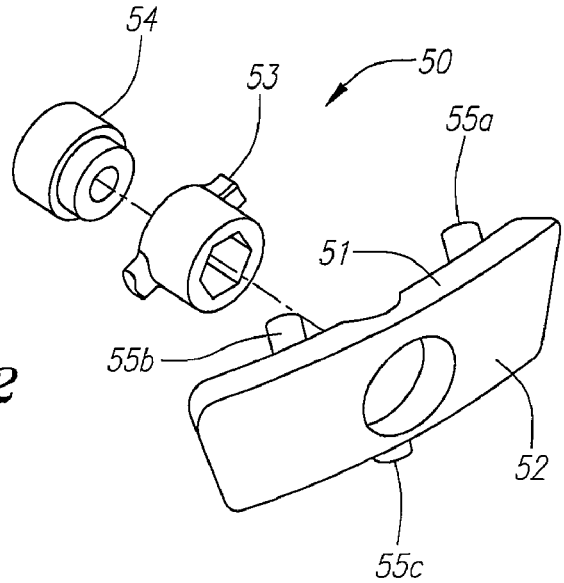
FIG. 12 is an exploded view of the weighting member with its locking mechanism.
Figure 13:
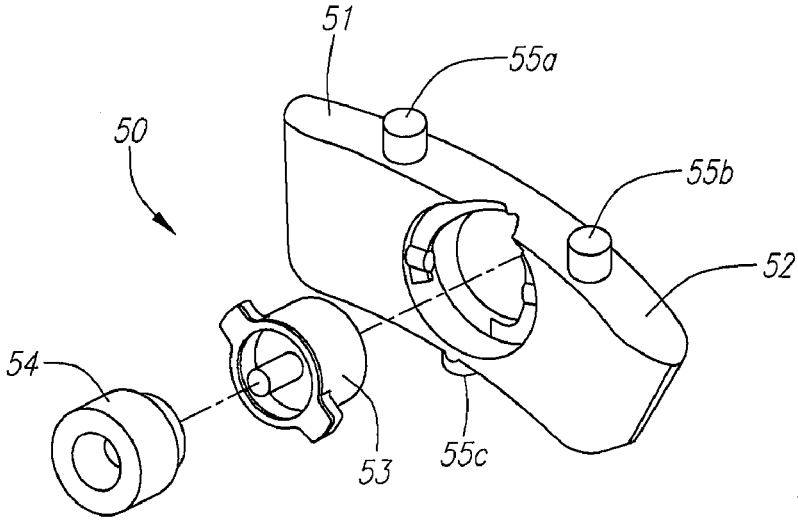
FIG. 13 is an exploded view of the weighting member with its locking mechanism.

As shown in FIGS. 11–13, the weight member 50 preferably has a body 51 with an aperture 52. A cam nut 53 is placed through the aperture 52 and a polymer bushing 54 engages with the cam nut 53. The body 51 also preferably has at least one locking projection 55. In a preferred embodiment, the body 51 has a plurality of locking projections 55, most preferably three locking projections 55*a*, 55*b* and 55*c*, as shown in FIGS. 12 and 13. Each locking projection 55 engages with a locking notch 44 to secure the weighting member 50. The locking mechanism of the weight member 50 preferably comprises the cam nut 53, the bushing 54 and the locking projections 55.

Figure 9:
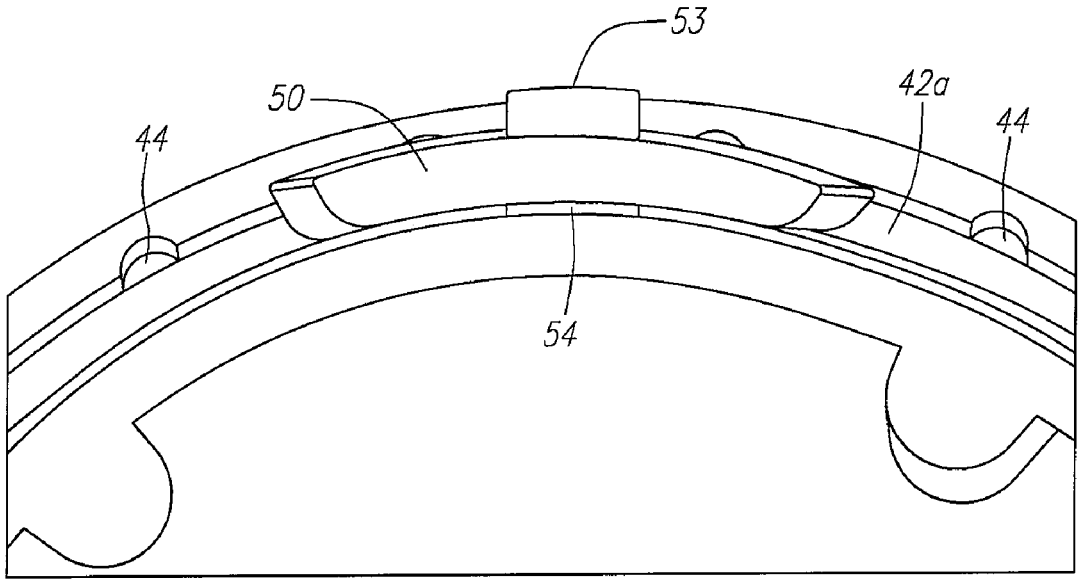
FIG. 9 is an isolated view of a weighting member in an unlocked position.
Figure 10:
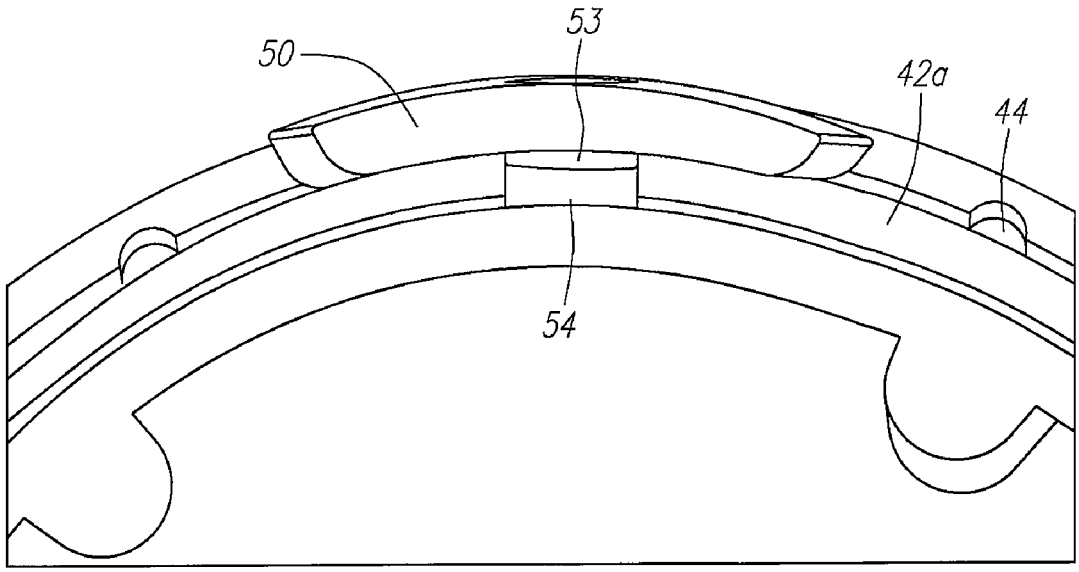
FIG. 10 is an isolated view of the weighting member in a locked position.

As shown in FIG. 9, in an unlocked position, the weight member 50 has the cam nut extending outward and the body 51 of the weight member 50 is free to move along the recess with each locking projection 55 moving along a corresponding arc-like track 42*a* and 42*b*. In this manner, a golfer may adjust the position of the weight member 50 to influence the center of gravity of the golf club head 20 and also the golf club 10. A desired center of gravity location of a golf club for a golfer may be selected from the group of far heel ward, mid-heel ward, slight heel ward, neutral, slight toe ward, mid-toe ward and far toe ward. Once a location is determined, the cam nut is secured inward and the bushing engages the wall of the body 22, as shown in FIG. 10. Each of the projections 55 is secured within a locking notch 44. The cam nut may be secured using a wrench, screwdriver or similar tool. In a preferred embodiment, the movement of the weight member from a far toe-ward position to a far heel ward position can move the center of gravity of the golf club head a distance of at least 0.254 centimeters. This movement can greatly change the ball flight characteristic for the golfer, enabling the golfer, or an instructor, the fit the golf club to the golfers ball striking abilities.

In determining a golfer's ball striking abilities, a method and system such as disclosed in U.S. Pat. No. 6,821,209 for a Method For Predicting A Golfer's Ball Striking Performance, assigned to Callaway Golf Company of Carlsbad, Calif., which is hereby incorporated by reference in its entirety.

In an alternative embodiment, the golf club head 20 has a plurality of weight member 50 all located along the recess 40. In such an alternative embodiment, two or three weight members 50 are utilized to influence the mass properties of the golf club head.

The golf club head 20 preferably has a high coefficient of restitution thereby enabling for greater distance of a golf ball hit with the golf club of the present invention. The coefficient of restitution (also referred to herein as "COR") is determined by the following equation:

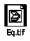

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face.

The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The present invention provides a golf club head 20 having a coefficient of restitution ranging from 0.81 to 0.94, as measured under conventional test conditions, and more preferably from 0.825 to 0.85.

Figure 14:
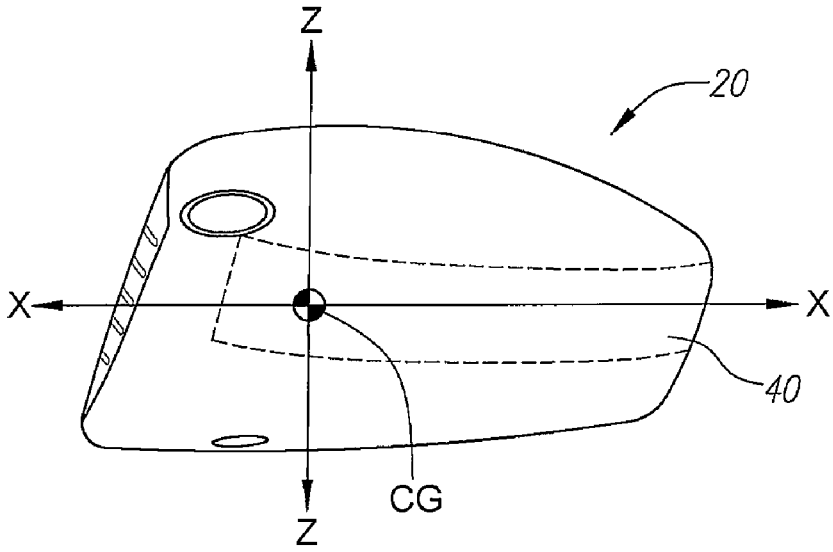
FIG. 14 is a side view of a golf club head illustrating a position of the center of gravity of the golf club head and a Z axis and X axis therethrough.
Figure 15:
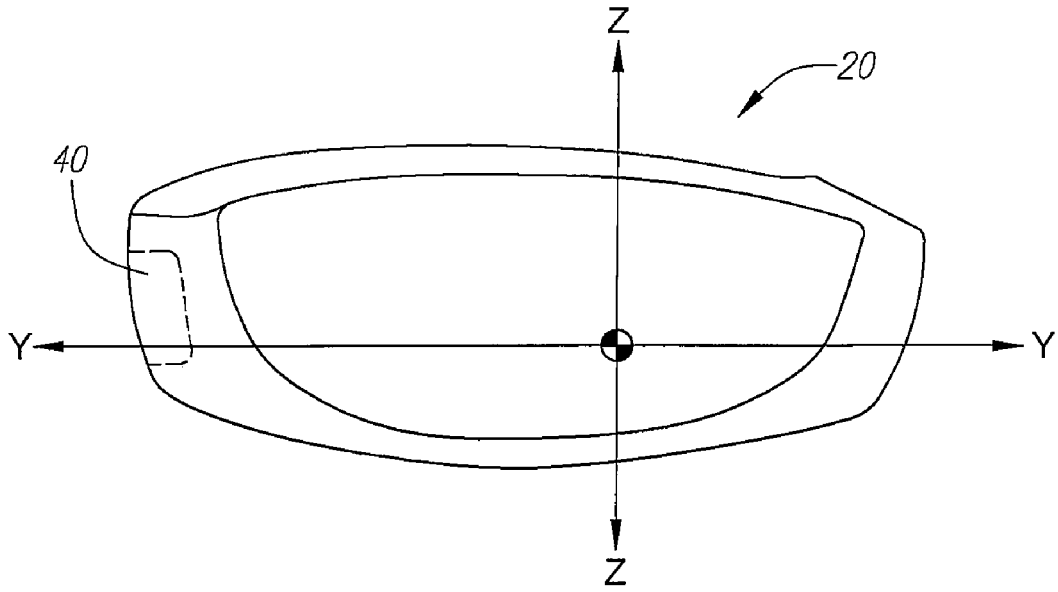
FIG. 15 is a front view of a golf club head illustrating a position of the center of gravity of the golf club head and a Z axis and Y axis therethrough.

FIGS. 14 and 15 illustrate the axes of inertia through the center of gravity of the golf club head. The axes of inertia are designated X, Y and Z. The X axis extends from the striking plate section 72 through the center of gravity, CG, and to the rear of the golf club head 40. The Y axis extends from the toe end 68 of the golf club head 40 through the center of gravity, CG, and to the heel end 66 of the golf club head 40. The Z axis extends from the crown section 62 through the center of gravity, CG, and to the sole section 76.

As defined in *Golf Club Design, Fitting, Alteration & Repair,* $4^{th}$ Edition, by Ralph Maltby, the center of gravity, or center of mass, of the golf club head is a point inside of the club head determined by the vertical intersection of two or more points where the club head balances when suspended. A more thorough explanation of this definition of the center of gravity is provided in *Golf Club Design*, . . . Fitting, Alteration & Repair.

Figure 16:
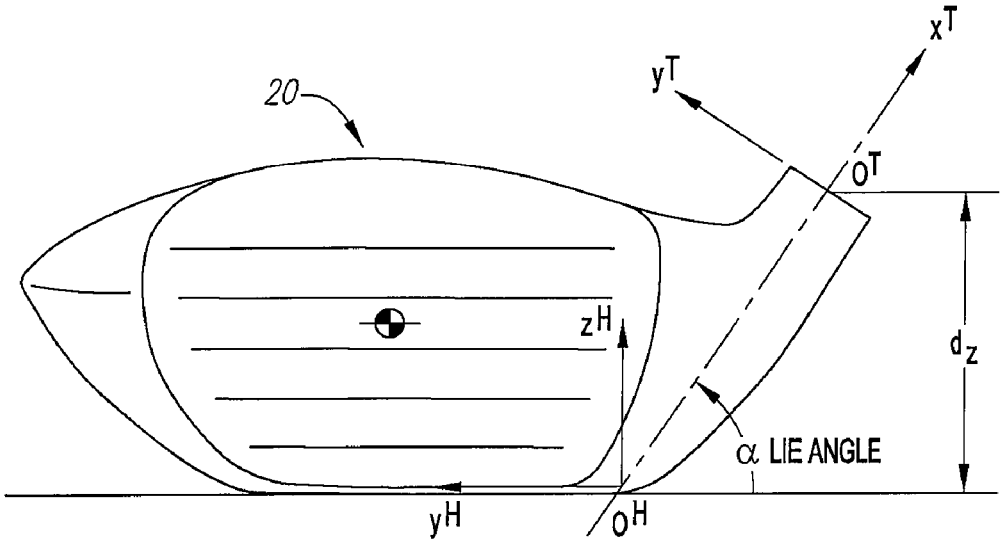
FIG. 16 is a front plan view of a golf club of the present invention illustrating the test frame coordinates $X^T$ and $Y^T$ and transformed head frame coordinates $Y^H$ and $Z^H$.
Figure 17:
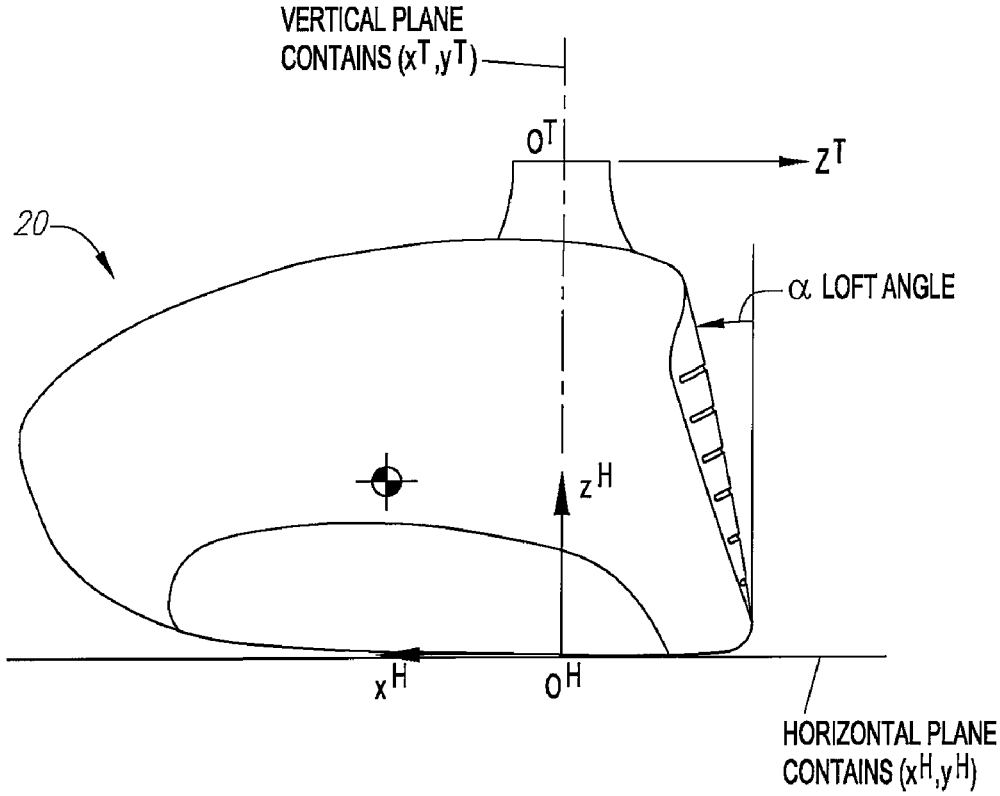
FIG. 17 is a toe end view of the golf club of the present invention illustrating the test frame coordinate $Z^T$ and transformed head frame coordinates $X^H$ and $Z^H$.

The center of gravity and the moment of inertia of a golf club head 20 are preferably measured using a test frame ($X^T$, $Y^T$, $Z^T$), and then transformed to a head frame ($X^H$, $Y^H$, $Z^H$), as shown in FIGS. 16 and 17. The center of gravity of a golf club head may be obtained using a center of gravity table having two weight scales thereon, as disclosed in U.S. Pat. No. 6,607,452, entitled High Moment Of Inertia Composite Golf Club, and hereby incorporated by reference in its entirety.

In general, the moment of inertia, lzz, about the Z axis for the golf club head 40 of the present invention will range from 1900 g-cm$^2$ to 3000 g-cm$^2$, preferably from 1990 g-cm$^2$ to 2500 g-cm$^2$, and most preferably from 1990 g-cm$^2$ to 2400 g-cm$^2$. The moment of inertia, lyy, about the Y axis for the golf club head 42 of the present invention will range from 900 g-cm$^2$ to 1700 g-cm$^2$, preferably from 950 g-cm$^2$ to 1500 g-cm$^2$, and most preferably from 965 g-cm$^2$ to 1200 g-cm$^2$. Table One list the moments of inertia for a 3-wood golf club head 40, a 7-wood golf club head 40, 9-wood golf club head 40 and 11-wood golf club head 40.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

What is claimed is:

1. A golf club head comprising:

a body having a face, a crown and a sole, the body having an arc-like recess extending from a heel end of the body to a toe end of the body, wherein the sole of the body comprises a ribbon portion and a bottom portion, and wherein the arc-like recess is located along the ribbon portion and the arc-like recess has a height ranging from 0.5 centimeter to 4.0 centimeters, a depth ranging from 0.2 centimeter to 2.0 centimeter, and an arc length ranging from 2 centimeters to 20 centimeters, the body having an arc-like track extending from the heel end of the body to the toe end of the body with a plurality of locking notches in communication with the arc-like track; and at least one weight member positioned within the arc-like recess and movable within the arc-like recess, the at least one weight member having at least one locking projection positioned within the arc-like track and movable within the arc-like track and capable of placement within each of the plurality of locking notches, the at least one weight member also having a locking mechanism for locking the at least one weight member in a position within the arc-like recess.

2. The golf club head according to claim 1 wherein the at least one weight member comprises a body that is composed of a material having a density greater than the density of the material of the body of the golf club head.

3. The golf club head according to claim 1 wherein the at least one weight member comprises a body that is composed of a tungsten material and the body of the golf club head is composed of a stainless steel material.

4. The golf club head according to claim 1 further comprising a second weight member positioned within the arc-like recess and movable within the arc-like recess, the second weight member having at least one locking projection positioned within the arc-like track and movable within the arc-like track and capable of placement within each of the plurality of locking notches, the second weight member also having a locking mechanism for locking the second weight member in a position within the arc-like recess.

5. The golf club head according to claim 1 wherein the locking mechanism comprises a locking cam nut and a bushing, the locking cam nut threadingly engaged within a threaded aperture in a body of the at least one weight member, the bushing engaging the body of the golf club head.

6. The golf club head according to claim 1 wherein the at least one weight member has a thickness ranging from 0.2 centimeter to 2.0 centimeters, a height ranging from 0.5 centimeter to 4.0 centimeters and a length ranging from 1.0 centimeter to 5.0 centimeters.

7. The golf club head according to claim 1 wherein the at least one weight member has a mass ranging from 5 grams to 25 grams.

8. The golf club head according to claim 7 wherein the body of the golf club head has a mass ranging from 90 grams to 250 grams.

9. A golf club head comprising:

a body having a face, a crown and a sole with a ribbon portion and a bottom portion, the body having an arc-like recess extending from a heel end of the body to a toe end of along the ribbon portion of the sole, the body having an upper arc-like track extending from the heel end of the body to the toe end of the body with a plurality of locking notches in communication with the upper arc-like track and a lower arc-like track extending from the heel end of the body to the toe end of the body with a plurality of locking notches in communication with the lower arc-like track; and at least one weight member positioned within the arc-like recess and movable within the arc-like recess, the at least one weight member having a body with a plurality of locking projections with at least one of the plurality of locking projections positioned within the upper arc-like track and movable within the upper arc-like track and capable of placement within each of the plurality of locking notches, and with at least one of the plurality of locking projections the positioned within the lower arc-like track and movable within the lower arc-like track and capable of placement within each of the plurality of locking notches, the at least one weight member also having a locking mechanism for locking the at least one weight member in a position within the arc-like recess.

10. The golf club head according to claim 9 wherein the body is composed of a material selected from the group consisting of steel alloys, titanium alloys, titanium, magnesium, magnesium alloys, aluminum and aluminum alloys.

11. The golf club head according to claim 9 wherein the recess of the body extends along 50% to 95% of the arc-length of the ribbon portion.

12. The golf club head according to claim 9 wherein the at least one weight member has a mass ranging from 5% to 25% of the mass of the golf club head.

13. The golf club head according to claim 9 wherein the body has a volume ranging from 130 cubic centimeters to 475 cubic centimeters.

* * * * *